US005377448A

United States Patent [19]

Boyd et al.

[11] Patent Number: 5,377,448

[45] Date of Patent: Jan. 3, 1995

[54] DOOR POSITIONING SYSTEM

[75] Inventors: Douglas E. Boyd, Dublin; Charles A. Burton, Columbus, both of Ohio

[73] Assignee: American Metal Door Company, Inc., Richmond, Ind.

[21] Appl. No.: 7,673

[22] Filed: Jan. 21, 1993

[51] Int. Cl.[6] ..... E05F 11/54

[52] U.S. Cl. ..... 49/360; 49/4; 49/139; 49/141; 49/362

[58] Field of Search ..... 49/362, 360, 139, 141, 49/4, 138, 102, 1

[56] References Cited

U.S. PATENT DOCUMENTS

| | | | |
|---|---|---|---|
| 879,883 | 2/1908 | Mull | 49/1 |
| 1,343,757 | 6/1920 | Akers | 49/1 |
| 1,816,258 | 7/1931 | Lake | 49/362 X |
| 3,072,394 | 1/1963 | Urquhart | 49/102 |
| 3,834,081 | 9/1974 | Catlett | 49/138 X |
| 3,872,622 | 3/1975 | Berk | 49/360 X |
| 4,370,826 | 2/1983 | Davidson | 49/362 X |

FOREIGN PATENT DOCUMENTS

| | | | |
|---|---|---|---|
| 520887 | 7/1953 | Belgium | 49/102 |

*Primary Examiner*—Philip C. Kannan
*Attorney, Agent, or Firm*—Barnes & Thornburg

[57] ABSTRACT

A door positioning mechanism with a moveable carriage driven by a motor through a lead screw, wherein the moveable carriage is connected to open and close the door by movement of the door rectilinearly along a track through the expedient of a drive train utilizing a multiple sheave and cable connection between the door and the moveable carriage. A hand disconnect is provided to disable the positioning mechanism and allow manual movement of the door. A thermal (fire switch) dead weight control is also provided to over-ride the positioning mechanism and automatically shut the door.

38 Claims, 3 Drawing Sheets

DOOR POSITIONING SYSTEM

BACKGROUND AND SUMMARY OF THE INVENTION

The present invention relates to door positioning systems for use in positioning doors, and particularly for use with doors that move with a rectilinear motion. More particularly, the invention relates to door positioning systems using pulleys, cables, and a lead screw to position rectilinearly moving doors.

Various applications such as sliding industrial doors in a manufacturing plant require that the doors be positioned rapidly. Conventional positioning systems for positioning doors include linear and rotary systems. Linear systems are available, but are typically high precision and, consequently, very expensive.

Rotary systems are a more economical alternative to linear systems. Rotary systems convert the rotary output of a motor to the desired linear door motion and are generally of the perpendicular or parallel type. In a perpendicular type system, the axis of rotation of the motor shaft is perpendicular to the direction of movement of the door. In a parallel type system, the motor shaft rotates about an axis that lies parallel to the line of motion of the door.

The basic form of the perpendicular motor system has a continuous loop of cable or chain running over a sheave mounted on the motor shaft (or on a shaft driven with the motor shaft). As the motor turns, it draws the cable or chain over the sheave, and the door moves with the cable (or chain). The many variations on this theme are associated with how the motor is integrated into the loop.

The method of placing the motor in the cable loop range from a single turn around the motor sheave, running through two idler pulleys, to a multi-turn windlass approach. One type of operator uses a single loop of cable with the motor at one end. This type of drive can only pull the door in one direction, because it is not possible to push the cable to drive the door in the other direction.

One of the disadvantages of a perpendicular cable drive, as usually practiced, is that the cable is not positively engaged with the driver sheave. Because of this, a larger contact pressure and total angle of contact are required to ensure that the cable does not slip on the sheave. Positive engagement is especially important if limit switches for the door travel are placed on the driver itself instead of on the door.

The basic forms of parallel motor systems are based on lead screws and threadless rods. The threadless rod principle involves a rod rotating within inclined rollers which are attached to the door. As the rod rotates, there is a component of the friction force which acts along the length of the rod. This component of the friction force causes the inclined rollers to travel back and forth along the rod, depending upon the direction of the rotation. As an example, a threadless rod concept is used by Horton Automatics on their Type 110 sliding door operator. A primary disadvantage of this type of drive system is the low available force. Only a component of the friction force is useful in driving the door, and it is therefore difficult to use this method for driving heavier doors at high speeds. For example, the Horton system provides a closing force of 30 pounds to the door. This would result in a very small acceleration on a 1200 pound door (approximately 10 in/sec$^2$). With this acceleration, it would take approximately 50 seconds for the door to reach 48 in/sec, and over that time, the door would travel approximately 10 feet. The operating time for a practical range of door sizes would be too long.

In another parallel type system, the motor rotates a threaded member, or lead screw, to positively drive a nut towards or away from the motor. However, large doors would require long lead screws. Long unsupported lead screws have problems with critical speeds which limit the motor speed. Limited motor speed in turn limits the acceleration and speed of the door.

A positioning system that would provide adequate acceleration to move a door weighing 1200 pounds or more, yet having a configuration that occupies a small volume would be a substantial improvement over conventional positioning systems.

According to the present invention, a door positioning system for use with a generally rectilinearly movable door comprises a lead screw extending in the direction of a track system for the door, a motor for driving the lead screw, and a carriage for threadedly engaging the lead screw to move therealong when the lead screw is driven. The invention also includes means for amplifying the movement of the carriage so that the door moves a predetermined multiple of the movement of the carriage, wherein the amplifying means provides a driving connection between the carriage and the door.

According to one aspect of the invention, the lead screw includes external threads and the carriage includes a nut having internal threads for engaging the external threads. The nut moves the carriage axially along the lead screw in response to rotation of the lead screw. The amplifying means includes a plurality of pulleys coupled to the nut and a cable coupled to the pulleys.

According to another aspect of the invention, a housing substantially envelopes the positioning system and the amplifying means further includes a plurality of pulleys coupled to the housing. The cable couples the housing pulleys to the carriage pulleys and to the door so as to multiply the speed and distance of movement of the nut along the lead screw so that the door moves a predetermined multiple of the movement of the nut.

Other objects and advantages of the invention will become apparent from the following description of a preferred embodiment presently perceived as the best mode for practice of the invention and consideration of the accompanying drawings.

BRIEF DESCRIPTION OF THE DRAWINGS

FIG. 5 is a sectional view taken along line 5—5 of FIG. 3 showing a bracket and pulleys to be mounted on the proximal end of the housing;

DETAILED DESCRIPTION

Figure 1:
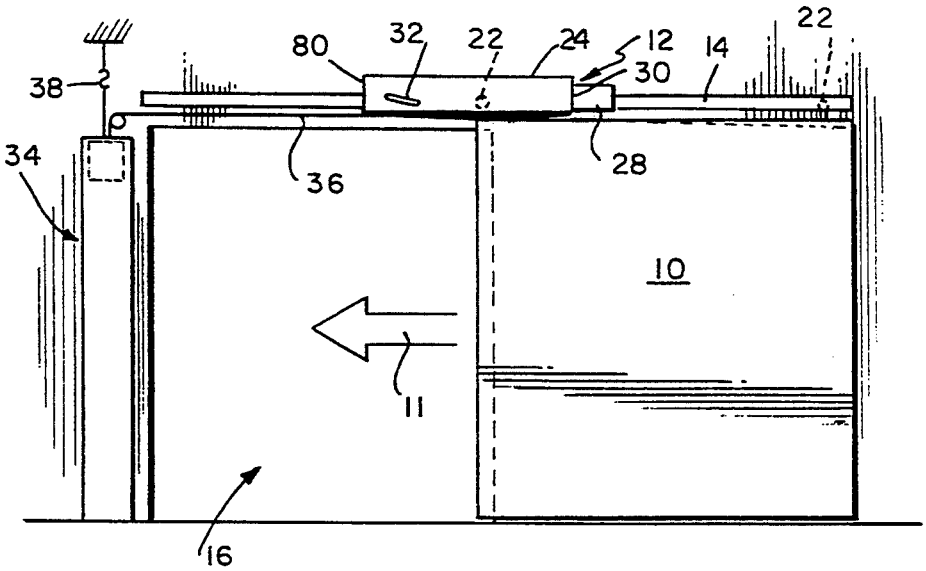
FIG. 1 shows a housing enclosing a door positioning system, the positioning system moving a door between an open position and a closed position.

FIG. 1 shows a door 10 being movable from the open position to a closed position (in the direction of arrow 11) by a positioning system 12 constructed according to the present invention. The door 10 is merely illustrative, and any type of door or panel can be moved by the positioning system 12. A track 14 is mounted on a wall and positioned above, and extending along, an opening 16 in the wall. The track 14 is configured to include a pair of parallel, roller-receiving channels 18 (FIG. 9) extending along the length of the track 14. A roller chassis 20 (FIG. 9) is connected to the door 10 and includes a plurality of rollers 22 that are arranged to ride in the channels 18 in the track 14. Thus, as shown in FIG. 1, the door 10 is suspended from the track 14 and is movable along the track 14 to open and close the opening 16 in the wall.

A housing 24 containing the driving mechanism is mounted to the wall and is illustratively located above the door 10. The illustrated housing 24 is positioned adjacent the track 14 and is coupled by an operating cable 26 to the door 10. Because of the amplification aspect of the invention, the housing 24 can be only a small fraction of the length of the door 10 and located at the midpoint of the range of door movement. A drive motor 28 for actuating the drive mechanism is mounted on a proximal end 30 of the housing 24. A manual release handle 32 for disconnecting the positioning system to allow for manually moving the door 10 for maintenance or other reasons is located on the outside of the housing 24. The drive motor 28 may be electric or pneumatic, or for that matter, any type of motor which will drive the system.

A dead weight 34 is coupled by a dead weight cable 36 to the door 10 for automatic actuation in the event of a fire. A fusible link 38 holds the dead weight 34 off the ground. In a high heat condition, the fusible link 38 melts and allows the dead weight 34 to fall, pulling the dead weight cable 36 and closing the door 10.

Figure 2:
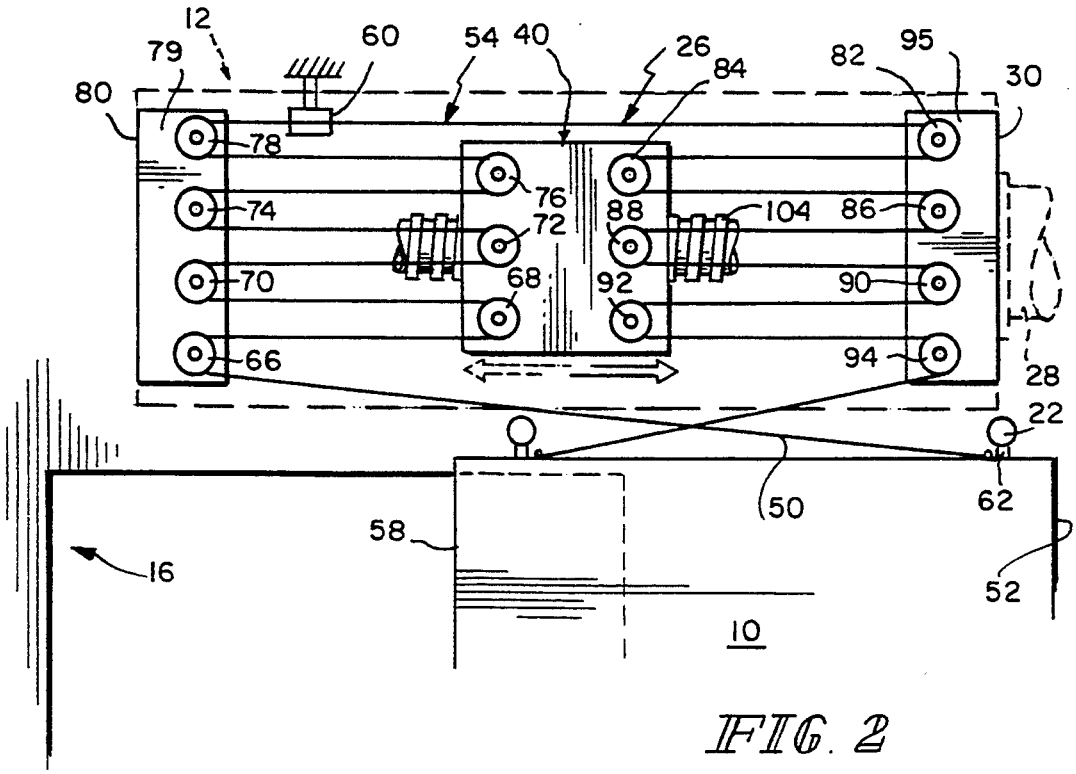
FIG. 2 is a schematic representation of a carriage, a system of pulleys, and a cable according to the present invention.
Figure 8:
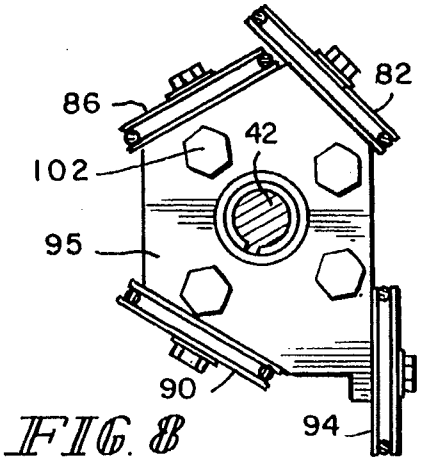
FIG. 8 is a front view of a positioning system configured according to the present invention.

FIG. 2 is a schematic representation of a positioning system 12 according to the present invention. The system includes a operating cable 26 for coupling the door 10 to the positioning system 12, a system of pulleys, a carriage 40 that is longitudinally movable inside the housing 24, and a drive motor 28 to move the carriage 40. A lead screw 42 (FIG. 8) couples the drive motor 28 to the carriage 40. As best seen in FIG. 8, the carriage 40 is essentially a nut, having a plurality of pulleys rotatably coupled thereto, that travels along the lead screw 42.

A preferred operating cable 26 is a 3/16 inch galvanized steel operating cable 26. The operating cable 26 has a first end 50 that is connected to a proximal end 52 of the door 10, a middle portion 54 that engages the system of pulleys, and a second end 56 that is connected to the distal end 58 of the door 10. A clamp 60 holds one segment of the operating cable 26 immovable relative to the housing 24. It will be understood that a chain or other suitable device can be used, but a cable has been found to be quieter and less sensitive to lubrication.

The illustrative pulley system includes fourteen pulleys. Six pulleys are rigidly coupled to the carriage 40, four pulleys are coupled the proximal end of the housing 24, and four pulleys are coupled to the distal end of the housing 24. In order to avoid excess wear on the carriage 40 and the lead screw 42 (FIG. 8), the pulleys are preferably aligned so that operating cable 26 segments extending between pulleys are always parallel to each other.

As shown schematically in FIG. 2, a first end 50 of the operating cable 26 is attached to the proximal end 52 of the door 10. From the attachment point 62, the operating cable 26 passes around pulleys 66, 68, 70, 72, 74, 76, and 78, respectively, and then through the clamp 60. Pulleys 66, 70, 74, and 78 are rotatably coupled to a bracket 79 (FIG. 4) that is attached to the distal end 80 of the housing 24, and pulleys 68, 72, and 76 are rotatably coupled to the carriage 40. The location of the clamp 60 is not critical. Preferably, it clamps the operating cable 26 to the housing and does not restrict the necessary movement of the carriage 40.

From the clamp 60, the operating cable 26 passes around pulleys 82, 84, 86, 88, 90, 92, and 94, respectively. The second end 56 of the operating cable 26 is attached to the distal end 58 of the door 10. Pulleys 82, 86, 90, and 94 are rotatably coupled to a bracket 95 (FIG. 5) that is attached to the proximal end 30 of the housing, and pulleys 84, 88, and 92 are rotatably coupled to the carriage 40.

In operation, it will be seen that as the carriage 40 moves to the right, as seen in FIG. 2, six of the segments of the operating cable 26 to the left of the carriage 40 increase in length. Since the operating cable 26 is clamped to the housing 24, the required additional operating cable 26 length is taken from the first end 50 of the operating cable 26 connected to the proximal end 52 of the door 10, and the operating cable 26 pulls the door 10 to the left.

Six of the segments of the operating cable 26 to the right of the carriage 40, as seen in FIG. 2, decrease in length as the carriage 40 moves to the right. Since the operating cable 26 is clamped to the housing 24, the excess length available due to the movement of the carriage 40 to the right is taken up by the second end 56 of the operating cable 26 coupled to the distal end 58 of the door 10, as the door 10 moves to the left.

Of course, as the carriage 40 moves to the left, as seen in FIG. 2, the opposite effect is achieved. Six of the segments of the operating cable 26 to the right of the carriage 40 increase in length, and the required additional operating cable 26 length comes from the second end 56 of the operating cable 26 coupled to the distal end 58 of the door 10, thus pulling the door 10 to the right. Six of the segments of the operating cable 26 to the left of the carriage 40 decrease in length, with the excess length taken up by the first end 50 of the operating cable 26 coupled to the proximal end 52 of the door 10.

Figure 3:
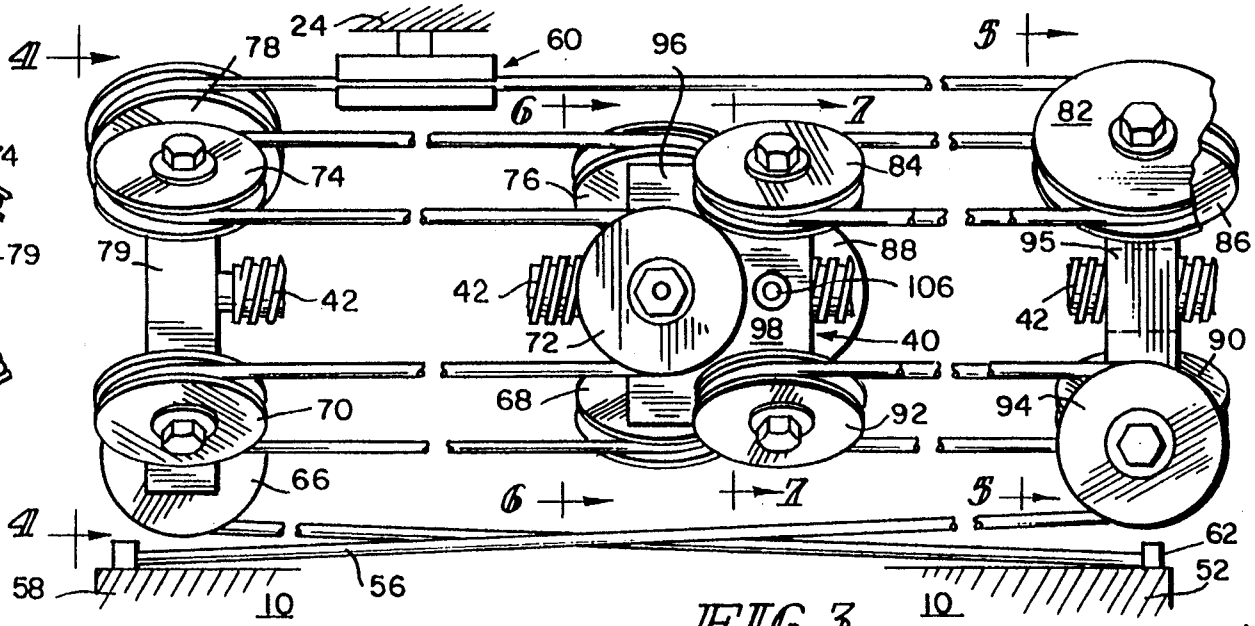
FIG. 3 is a schematic representation of the relative position of the pulleys, the carriage, and the cable inside the housing.

FIG. 3 shows one illustrative layout of the operating cable 26, pulleys 66–94, and carriage 40 relative to the door 10. The carriage 40 is coupled to a lead screw 42 (FIG. 8) and moves back and forth horizontally between the proximal and distal ends 30, 80 of the housing 24. The illustrative use of multiple passes of the operating cable 26 between the brackets 79 and 95 and the carriage 40 provides a 6-to-1 motion amplification, which allows a relatively short lead screw 42 (FIG. 8) to move a relatively large door 10. It will be appreciated that other multiples may be used.

To reduce wear on the carriage 40 and the lead screw 42, it is very important that loads on the operating cable 26 be balanced around the carriage 40. Consequently, all of the passes of the operating cable 26 should be generally parallel to each other. In order to balance the loads around the carriage 40 and keep the passes parallel, the illustrative hexagonal pulley pattern may be used (FIGS. 6 and 7).

Figure 7:
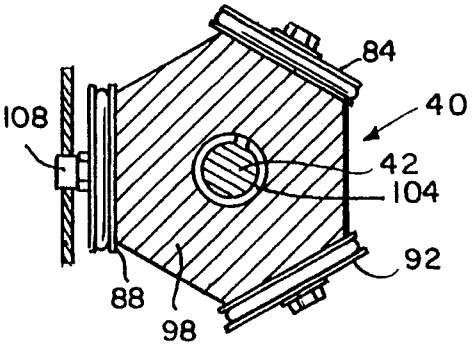
FIG. 7 is a sectional view taken along line 7—7 of FIG. 3 showing a second hexagonal bracket mounted on the carriage.
Figure 6:
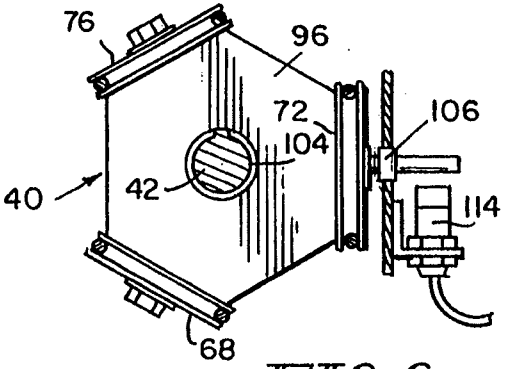
FIG. 6 is a sectional view taken along line 6—6 of FIG. 3 showing a first hexagonal bracket mounted on the carriage.
Figure 8:
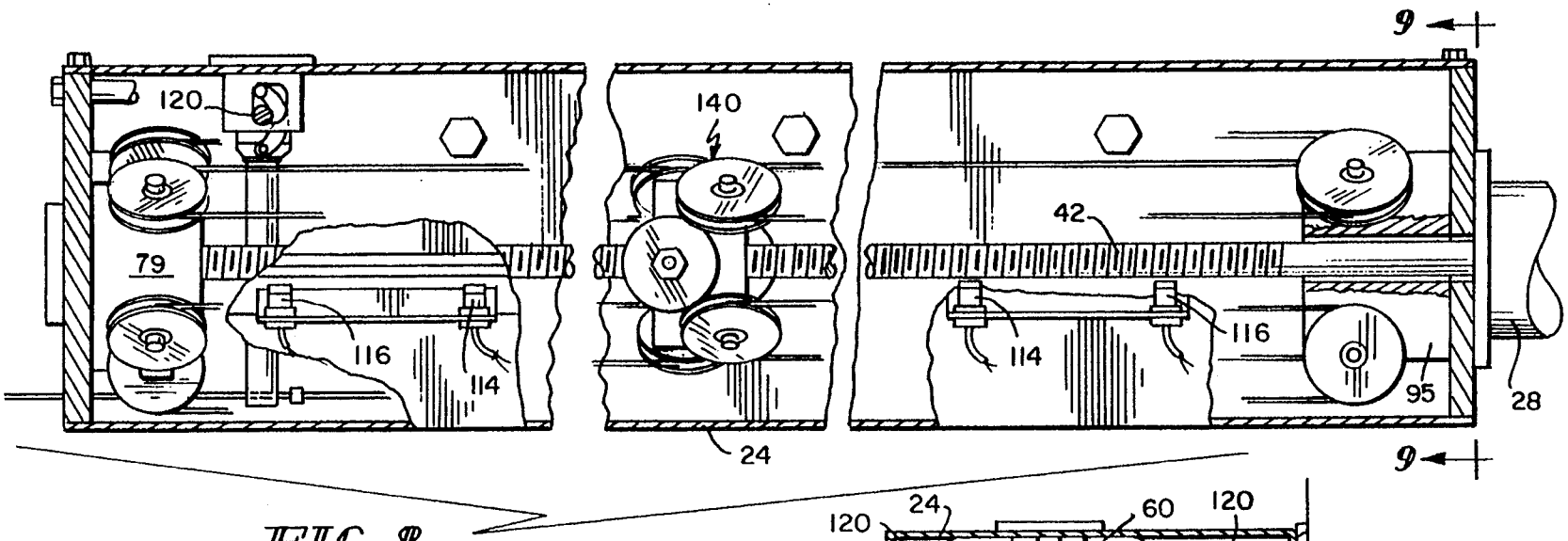

The carriage 40 has two sets of pulleys, with each set arranged so as to be positioned on alternating faces of the hexagonal brackets 96, 98 (FIGS. 6 and 7). The brackets 96 an 98 abut each other and are rotated relative to each other so that the pulley holding faces of each bracket 96, 98 are not in registry. Thus, when the carriage 40 is viewed from either end of the housing 24, it would appear that a pulley is positioned on each face of a hexagonal bracket 96 or 98.

Figure 4:
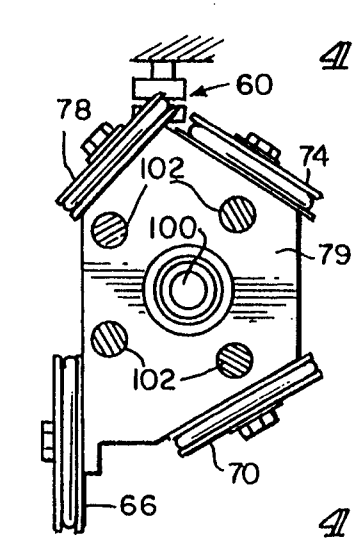
FIG. 4 is a sectional view taken along line 4—4 of FIG. 3 showing a bracket and pulleys to be mounted on the distal end of the housing.

FIGS. 4 and 5 show irregularly shaped brackets 79 and 95 for coupling pulleys to the housing 24. Each bracket 79, 95 includes a center aperture 100 for allowing the lead screw 42 to extend through the bracket 79, 95, and bolt receiving apertures 102. Bolts (not shown) pass through the bolt receiving apertures 102 for mounting the brackets 79 and 95 to the housing 24.

The brackets 79 and 95 are mounted to the distal and proximal ends 30 and 80 of the housing 24, respectively, so as to align the pulleys mounted on the brackets 79 and 95 with the pulleys mounted on the carriage 40. Aligning the pulleys on the brackets 79 and 95 with the pulleys on the carriage 40 maintains all of the passes of the operating cable 26 in parallel relation to each other.

FIGS. 6 and 7 show the hexagonal brackets 96 and 98 mounted on the carriage 40. Three pulleys are rotatably attached to each bracket 96, 98 on alternate faces thereof. Each hexagonal bracket 96, 98 also includes a threaded center aperture 104 for engaging the threaded lead screw 42 (FIG. 8).

In order to maintain the carriage 42 in alignment with the brackets 79 and 95 attached to the housing 24, a pair of cam followers 106 and 108 (FIGS. 6 and 7) extend from vertical faces of the carriage brackets 96, 98. Guide plates 112 are coupled to the ends 30, 80 of the housing 24 and extend therebetween. The cam followers 106 and 108 extend through slots 110 (FIG. 9) formed between the guide plates 112, wherein the guide plates 112 provide bearing surfaces for the cam followers 106 and 108. The cam followers 106 and 108 cooperate with the guide plates 112 to maintain the hexagonal brackets 96 and 98 in alignment with the brackets 79 and 95 attached to the housing 24. While one cam follower would be able to eliminate the rotation of the carriage 40 relative to the housing 24, two are used to help balance the loads on the lead screw 42. At the same time, the cam followers 106 and 108 (FIGS. 6 and 7) help to support and laterally constrain the carriage 42, and therefore the lead screw 42, which helps to reduce critical speed concerns.

The first cam follower 106 passes over proximity sensors 114 and 116 mounted in the housing 24. The proximity sensors 114 and 116 serve as deceleration switches and stop switches, respectively. The positioning of the sensors 114 and 116 is best shown in FIG. 8.

FIG. 8 is a front view of a door positioning system 12 of the present invention, showing the relative positions of the structural components. The threaded lead screw 42 extends through the brackets 79 and 95 to engage the carriage 40. The proximity sensors 114 and 116 are positioned near each end 30, 80 of the housing 24. The inboard sensor 114 at each end acts as a deceleration switch and the outboard sensor 116 at each end acts as a stop switch.

On the left side of the housing 24, as seen in FIG. 8, the operating cable 26 is clamped to the housing 24. Under emergency conditions, the operating cable 26 is releasable to allow the door 10 to be moved without motor operation. The clamp 60 is an over-center type linkage that squeezes the operating cable 26 between two shoes. The linkage is rotated by a clamp shaft 120 that extends through the housing 24 and runs through the wall. A handle 32 is coupled to each end of the clamp shaft 120, allowing a person to disconnect the operator from either side of the door 10. For fire doors, the arrangement allows the operating cable 26 of an automatic closer to rotate the clamp shaft 120 prior to moving the door 10, if the door 10 is a self-closing fire door.

Figure 9:
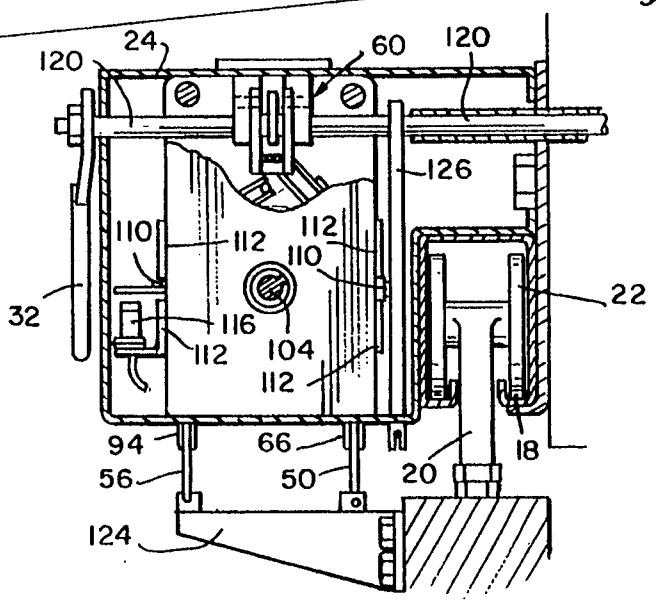
FIG. 9 is an end view of the present invention taken along line 9—9 of FIG. 8.

FIG. 9 is an end view taken along line 9—9 in FIG. 8. The track 14 is rigidly mounted to the wall with the roller-receiving channels 18 positioned at the bottom of the track 14. The door 10 hangs from the roller chassis 20 which engages the roller-receiving channels 18. A operating cable attachment bracket 124 is rigidly mounted on the door 10.

The housing 24 is attached to the wall and to the track 14 and configured to allow the operating cable 26 to be connected to the coupling bracket 124 to drive the door 10. The clamp shaft 120 passes through the housing 24 and the wall to allow actuation of the manual handle from either side of the door 10. A trip lever 126 is connected to clamp shaft 120 between the housing 24 and the track 14. A knot (not shown) in the dead weight cable 36 is positioned to interfere with the trip lever 126 when the fusible link 38 melts and pulls the dead weight cable 36. The knot pulls the trip lever 126 to disengage the clamp 60 from the operating cable 26. When the clamp 60 is disengaged, the door 10 can be pulled by the falling action of the dead weight 34 without any resistance from the motor 28 and lead screw 42.

While the illustrative embodiment of the invention uses an electric motor 28 to rotate a lead screw 42 to drive the carriage 40, the invention is not limited to electric motors. Pneumatic and hydraulic drivers may be used to move a carriage 40 in a linear fashion in order to open and close doors. For example, a hydraulic or pneumatic piston and cylinder arrangement could be used to move the carriage 40.

Although the invention has been described in detail with reference to certain preferred embodiments, variations and modifications exist within the scope and spirit of the invention as described and defined in the following claims.

We claim:

1. A door positioning system for use with a rectilinearly movable door mounted on a track system, said positioning system comprising:

a driver comprising a rectilinearly movable carriage means and means for driving said carriage means;

amplification means for drivingly connecting said driver to the door and for amplifying the speed and distance of movement of said carriage means such that said door moves a predetermined multiple of the movement of said carriage means;

a housing containing said driver and said amplification means for said predetermined multiple of the movement of said carriage means; and wherein the length of said housing is smaller than a length of said door.

2. The positioning system of claim 1, wherein the amplification means includes pulley means and operating cable means coupled to said driver and disposed within said housing.

3. The positioning system of claim 2, wherein the pulley means includes first pulley means coupled to the carriage means and second pulley means coupled to the housing means and the operating cable means is coupled to the first and second pulley means and to the door to amplify the movement of the carriage means.

4. The positioning system of claim 2, wherein said driver includes a threaded lead screw and the carriage means includes nut means for engaging the threaded lead screw.

5. The positioning system of claim 4, wherein said driver includes a motor drivingly coupled to the threaded lead screw.

6. The positioning system of claim 5, wherein the nut means includes threaded means for engaging the lead screw so that the nut means moves along the lead screw in response to rotation of the lead screw.

7. The positioning system of claim 4, wherein the pulley means is coupled to the nut means and the operating cable means is coupled to the pulley means and the door to move the door a predetermined multiple of the movement of the nut means.

8. The positioning system of claim 1, further comprising cam follower means coupled to the carriage means.

9. The positioning system of claim 8, further comprising guide rail means, wherein the cam follower means engages the guide rail means to provide lateral support for the carriage means.

10. A door positioning system for use with a rectilinearly movable door mounted on a track system, said positioning system comprising:

lead screw means extending in the direction of the track system;

motor means for driving the lead screw means;

carriage means for engaging the lead screw means to move in the direction of the track system in response to movement of the lead screw means;

means for amplifying the movement of the carriage means to move the door a predetermined multiple of the movement of the carriage means, said amplifying means including a plurality of pulleys entrained by a cable means which has an intermediate point fixedly clamped, said cable means providing a driving connection between the carriage means and the door; and means for releasing said clamp on said cable means to permit movement of said door independent of said motor means.

11. The positioning system of claim 10, wherein the lead screw means includes a lead screw and the motor means includes a motor for rotating the lead screw.

12. The positioning system of claim 11, wherein the lead screw includes external threads and the carriage means includes a nut having internal threads for engaging the external threads to move the nut axially along the lead screw in response to rotation of the lead screw.

13. The positioning system of claim 10, wherein the amplifying means includes a first plurality of pulleys coupled to the nut and operating cable means coupled to the first pulleys to provide a driving connection with the door.

14. The positioning system of claim 13, further comprising a housing for substantially enclosing the amplifying means, lead screw and carriage means; and wherein the amplifying means further includes a second plurality of pulleys coupled to the housing: and wherein the length of said housing in the direction of said track system is smaller than a length of the door.

15. The positioning system of claim 14, wherein the operating cable means includes an operating cable coupled to the first and second pluralities of pulleys and attached to the door so as to multiply the speed and distance of movement of the carriage means so that the door moves a predetermined multiple of the movement of the carriage means.

16. A door positioning system for use with a rectilinearly movable door mounted on a track system, said positioning system comprising:

a driven mover mounted for rectilinear movement above and along the track system;

amplifying pulley and cable means for moving the door a predetermined multiple of the movement of the driven mover;

the cable means including cable segments entrained between the pulley means;

wherein the pulley and cable means are aligned so that all cable segments between the pulley means are parallel; and a housing for containing said driven mover and pulley and cable means, said housing extending longitudinally along and above the track system.

17. The positioning system of claim 16, wherein the pulley and cable means includes two hexagonal brackets mounted on the driven mover, a first plurality of pulleys rotatably mounted to the hexagonal brackets, two irregularly shaped brackets, one of said irregularly shaped brackets mounted to the distal end of the housing, the other irregularly shaped bracket mounted to the proximal end of the housing, a second plurality of pulleys rotatably mounted to the two irregularly shaped brackets, and wherein the hexagonal brackets and the irregularly shaped brackets are so shaped and aligned as to keep the cable segments parallel.

18. A closure operating system for operating a rectilinearly moveable closure mounted to ride on a track to open-up and close-off an opening comprising:

a rectilinearly moveable carriage;

driving means to rectilinearly move the carriage;

an amplification system comprising: at least two rotational means fixedly located adjacent opposite ends of the opening, at least two additional rotational means located on said moveable carriage, and a cable means with two cable ends each attached to the closure means and with an intermediate cable portion drawn between the at least two fixedly located rotational means and said at least two additional rotational means located on said carriage to provide amplified movement of the closure means upon rectilinear movement of the carriage which causes both cable ends to move an equal distance.

19. The closure means of claim 18 wherein the fixed rotational means are located inboard of outer extremities of the opening to be closed by the closure member.

20. The closure system of claim 18 wherein there are more fixedly located rotational means that there are additional rotational means on said moveable carriage.

21. The closure means of claim 20 wherein the fixed rotational means are located inboard of outer extremities of the opening to be closed by the closure member.

22. The closure system of claim 20 wherein the rotational means and the additional rotational means are oriented with respect to one another so that portions of the cable means extending therebetween are substantially parallel to one another.

23. The closure means of claim 22 wherein the fixed rotational means are located inboard of outer extremities of the opening to be closed by the closure member.

24. The closure system of claim 18 wherein the cable means has a point on its intermediate length that is secured from moving.

25. The closure means of claim 24 wherein there is a releasable clamp for securing the cable means from moving at the point on its intermediate length and wherein there is an operator to release the clamp to unsecure the cable means and permit the closure means to be closed without rectilinear movement of the carriage means.

26. The closure means of claim 24 wherein the fixed rotational means are located inboard of outer extremities of the opening to be closed by the closure member.

27. The closure means of claim 26 wherein there is a releasable clamp for securing the cable means from moving at the point on its intermediate length and wherein there is an operator to release the clamp to unsecure the cable means and permit the closure means to be closed without rectilinear movement of the carriage means.

28. The closure system of claim 24 wherein the rotational means and the additional rotational means are oriented with respect to one another so that portions of the cable means extending therebetween are substantially parallel to one another.

29. The closure means of claim 28 wherein the fixed rotational means are located inboard of outer extremities of the opening to be closed by the closure member.

30. The closure means of claim 28 wherein there is a releasable clamp for securing the cable means from moving at the point on its intermediate length and wherein there is an operator to release the clamp to unsecure the cable means and permit the closure means to be closed without rectilinear movement of the carriage means.

31. The closure system of claim 24 wherein there are more fixedly located rotational means than there are additional rotational means on said moveable carriage.

32. The closure means of claim 31 wherein there is a releasable clamp for securing the cable means from moving at the point on its intermediate length and wherein there is an operator to release the clamp to unsecure the cable means and permit the closure means to be closed without rectilinear movement of the carriage means.

33. The closure means of claim 31 wherein the fixed rotational means are located inboard of outer extremities of the opening to be closed by the closure member.

34. The closure means of claim 33 wherein there is a releasable clamp for securing the cable means from moving at the point on its intermediate length and wherein there is an operator to release the clamp to unsecure the cable means and permit the closure means to be closed without rectilinear movement of the carriage means.

35. The closure system of claim 31 wherein the rotational means and the additional rotational means are oriented with respect to one another so that portions of the cable means extending therebetween are substantially parallel to one another.

36. The closure means of claim 35 wherein there is a releasable clamp for securing the cable means from moving at the point on its intermediate length and wherein there is an operator to release the clamp to unsecure the cable means and permit the closure means to be closed without rectilinear movement of the carriage means.

37. The closure means of claim 35 wherein the fixed rotational means are located inboard of outer extremities of the opening to be closed by the closure member.

38. The closure means of claim 37 wherein there is a releasable clamp for securing the cable means from moving at the point on its intermediate length and wherein there is an operator to release the clamp to unsecure the cable means and permit the closure means to be closed without rectilinear movement of the carriage means.

* * * * *